US012232576B2

(12) United States Patent
Coursimault

(10) Patent No.: US 12,232,576 B2
(45) Date of Patent: Feb. 25, 2025

(54) ADJUSTMENT SYSTEM

(71) Applicant: ZEDEL, Crolles (FR)

(72) Inventor: Antoine Coursimault, Grenoble (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 18/227,126

(22) Filed: Jul. 27, 2023

(65) Prior Publication Data

US 2024/0032656 A1 Feb. 1, 2024

(30) Foreign Application Priority Data

Jul. 29, 2022 (FR) ..... 2207933

(51) Int. Cl.
*A44B 11/06* (2006.01)
*A44B 11/25* (2006.01)

(52) U.S. Cl.
CPC ..... *A44B 11/065* (2013.01); *A44B 11/2511* (2013.01)

(58) Field of Classification Search
CPC . A44B 11/065; A44B 11/2511; A44B 11/006; A44B 11/008; Y10T 24/4736; Y10T 24/4755; Y10T 24/4773
See application file for complete search history.

(56) References Cited

U.S. PATENT DOCUMENTS

| | | | | |
|---|---|---|---|---|
| 3,523,340 | A * | 8/1970 | Stoffel | A44B 11/2511 24/639 |
| 5,005,220 | A | 4/1991 | Gaiatto et al. | |
| 5,566,427 | A | 10/1996 | Lathrop | |
| 6,718,602 | B1 * | 4/2004 | Chang | A43C 7/00 24/712.1 |
| 2016/0219986 | A1 | 8/2016 | Fiedler et al. | |
| 2016/0374459 | A1 * | 12/2016 | Coutant | A45F 3/047 224/600 |
| 2019/0380451 | A1 * | 12/2019 | Geist | A44B 11/065 |
| 2022/0256980 | A1 * | 8/2022 | Hortnagl | A42B 3/08 |

FOREIGN PATENT DOCUMENTS

| | | | |
|---|---|---|---|
| EP | 3 053473 | B1 | 4/2017 |
| ES | 2 003 525 | A6 | 11/1988 |
| NO | 172 965 | B | 6/1993 |
| NZ | 214266 | A | 11/1987 |
| WO | 2010/087998 | A1 | 8/2010 |

* cited by examiner

*Primary Examiner* — Jack W Lavinder
(74) *Attorney, Agent, or Firm* — Oliff PLC

(57) ABSTRACT

An adjustment system comprises a strap and an adjustment buckle configured to adjust the strap. The adjustment buckle comprises a body defining a first through hole and a second through hole extending over the thickness of the body. A partitioning wall is fixed to the body. The partitioning wall separates the first through hole and the second through hole in a first direction perpendicular to the thickness of the body. The strap makes a loop inside the body and passes round the partitioning wall. A cover is fixed to the body and installed facing the partitioning wall. The cover and the partitioning wall are separated by a larger distance than the thickness of the strap.

14 Claims, 6 Drawing Sheets

ADJUSTMENT SYSTEM

BACKGROUND OF THE INVENTION

The invention relates to an adjustment system.

PRIOR ART

A large number of adjustment strap configurations are known comprising a through hole with a rod that divides the through hole into a first portion and a second portion. The loop defines a ring. The strap passes through the through hole and passes round the rod. A first strand of the strap enters the through hole until it reaches the rod, and the strap passes round the rod and comes back out of the through hole via the second strand that is substantially parallel to the first strand. Once the strap has been pulled tight, the second strand is jammed against the loop by means of the first strand.

However, in use, the tension in the strap can vary and the strap loop can deform which is expressed by movement of the strap strands with respect to the adjustment buckle. This results in maladjustment of the initial configuration.

To keep the required adjustment, movable rods are known that block the strap against one of the edges of the ring. The movable rods have teeth that sink into the strap to prevent the strap from sliding. A part fitted movable between a first position and a second position is also known. In the first position, the available space is much larger than the cross-section of the strap to enable the strap to slide easily in the through hole thereby making adjustment of the strap easier to perform.

Once the strap has been fitted in place, the movable part is folded back to its second position so as to block the strap against the ring thereby preventing loss of adjustment. The strap is jammed between the body of the adjustment buckle and the movable part. However, once the movable part has blocked the strap, it is almost no longer possible to adjust the strap which is problematic. This also requires the use of a movable part which complicates the engineering of the adjustment buckle.

OBJECT OF THE INVENTION

One object of the invention consists in providing an adjustment system that procures a good preservation of the adjustment of the strap as in devices of the prior art when the strap is tensioned and that procures a better preservation of the adjustment when the tension in the strap decreases while avoiding the use of a movable blocking part.

The strap adjustment system is remarkable in that it comprises:

- a strap having a thickness that is smaller than a width that is itself smaller than a length, the strap being divided into a first strand and a second strand;
- an adjustment buckle configured to perform adjustment of the strap, the adjustment buckle defining a channel receiving the strap, the strap being able to slide in the channel by pulling on the first strand or the second strand, the channel having a width at least equal to the width of the strap and a height strictly larger than the thickness of the strap;
- wherein the adjustment buckle has a body, a partitioning wall and a cover that define the channel, the strap being inserted in the body via the first strand and passing round the partitioning wall to define a loop and exit from the body via the second strand;

- wherein the cover and the partitioning wall define a slot for the strap to pass through and the cover is separated from the partitioning wall by a distance strictly larger than the thickness of the strap and less than three times the thickness of the strap, the cover being facing the strap in a first direction to form an obstacle to enlargement of the loop,
- wherein the first direction is a direction of measurement of the thickness of the strap between two deformation points of the strap, the two deformation points corresponding to two contact points between the strap and the partitioning wall between which the strap makes a U-turn.

In one development, the cover defines a plurality of obstacles.

In advantageous manner, the cover is fitted removable with respect to the body.

It is also advantageous to provide for the at least one partitioning wall to be mounted fixedly on the cover.

In another development, the at least one partitioning wall is mounted fixedly on the body.

In a particular embodiment, the cover continuously covers the partitioning wall and the first strand arranged in the body in the first direction.

In advantageous manner, the body defines at least one through hole receiving one of the first strand or the second strand of the strap and the cover covers the through hole.

It is further advantageous to provide for the cover to be clip-fastened on the body.

In an advantageous embodiment, the cover is mounted sliding on the body, the cover defining a hole for the strap to pass through in a bottom surface designed to be facing a hole of the body and forming the obstacle in a top surface.

Preferably, the partitioning wall only extends over a part of the thickness of the body between the top surface and the bottom surface.

BRIEF DESCRIPTION OF THE DRAWINGS

Other advantages and features will become more clearly apparent from the following description of particular embodiments of the invention given for non-restrictive example purposes only and represented in the appended drawings, in which.

DESCRIPTION OF THE EMBODIMENTS

Figure 1:
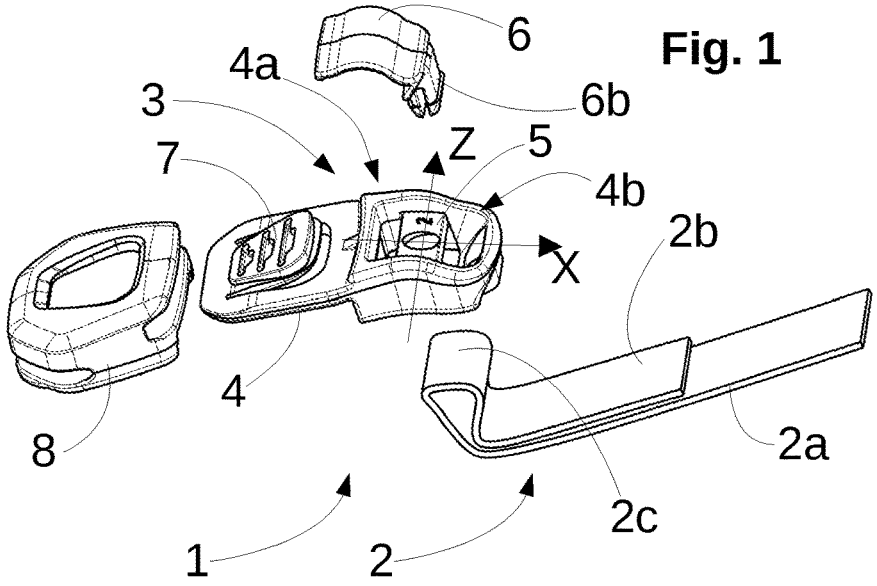
FIG. 1 schematically represents an exploded view of a first embodiment of an adjustment system according to the invention.

FIGS. 1 to 17 illustrate different embodiments of an adjustment system 1 that is configured to adjust the length of a strap 2. The adjustment system 1 comprises a strap 2 having a smaller thickness than a width that is itself smaller than a length.

The adjustment system 1 comprises an adjustment buckle 3 configured to perform adjustment of the strap 2. The strap 2 slides inside the adjustment buckle 3 so as to define its effective length.

The adjustment buckle 3 defines at least one channel for passage of the strap 2. The channel has a width that is greater than or equal to the width of the strap 2. The channel has a height that is strictly greater than the thickness of the strap 2. The width of the channel is measured in the same direction as the width of the strap 2 and the height of the channel is measured in the same direction as the thickness of the strap. These two precautions result in sliding of the strap 2 not being hampered in the adjustment phases where the strap 2 has to slide inside the adjustment buckle 3. In advantageous manner, the length of the channel is at least equal to once the width of the strap 2, more preferentially at least 1.5 times the width of the strap 2 and even more preferentially at least twice the width of the strap 2. The more the length of the channel is increased, the more the friction against the walls of the channel is increased which makes loosening more complicated.

The channel imposes a deformation of the strap for the latter to form a loop. The channel can impose an angular deformation equal to 180°, for example the channel is substantially in the form of a U-shape. As an alternative, the channel imposes an angular deformation of more than 180°. The channel can then be of any shape. The strap and the channel define several contact points. The contact points define two or at least two deformation points between which the strap makes a U-turn, i.e. the strap extending from the first strand to the second strand, it changes direction to return to its point of entry in the adjustment buckle or substantially to its point of entry in the adjustment buckle.

The strap 2 enters and exits the adjustment buckle 3 via the same face, preferably the face designed to be in contact with the user. The channel is defined at least partly by a body 4, a partitioning wall 5 and a cover 6. The strap 2 passes round the partitioning wall 5 to define the loop.

Outside the body 4, the two strands of the strap 2 join up and place themselves on one another so that one of the strands is jammed between the body 4 and the other strand. Preferably, the two strands are jammed between the body and the user.

In order to inhibit maladjustment of the length of the strap when the tension in the strap decreases, it is advantageous for the cover to form an obstacle to enlargement of the loop. The obstacle is facing the strap between the deformation points of the partitioning wall that impose deformation of the strap over at least 180°. The obstacle is located facing the strap in the direction of measurement of the thickness of the strap. As it is located facing the strap, the obstacle prevents the loop from enlarging. The strap can deform slightly, but the variations of size will greatly limit the loss of adjustment or even result in similar to-and-fro movements of the strap strand. As an alternative or as a complement, an obstacle can be present in the extension of the first strand, i.e. in the direction that extends the first strand inside the body 4.

In the embodiments illustrated in FIGS. 1 to 14, the body 4 defines a first through hole 4*a* and a second through hole 4*b* that each link a top face and a bottom face. The holes pass through the body in a direction Z that defines the direction of the thickness of the body 4. The body 4 also defines the partitioning wall 5. The partitioning wall 5 separates first through hole 4*a* and second through hole 4*b* in a first direction X perpendicular to a second direction Z that links the top face to the bottom face. Depending on the embodiments, the cover 6 is fitted movable or immovable with respect to the body 4.

Figure 15:
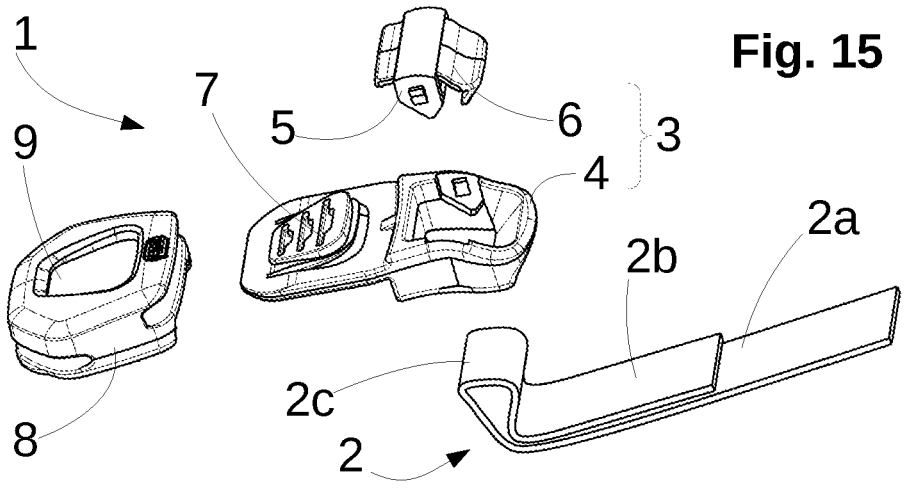
FIG. 15 schematically represents an exploded view in perspective of a fourth embodiment of an adjustment system according to the invention.
Figure 16:
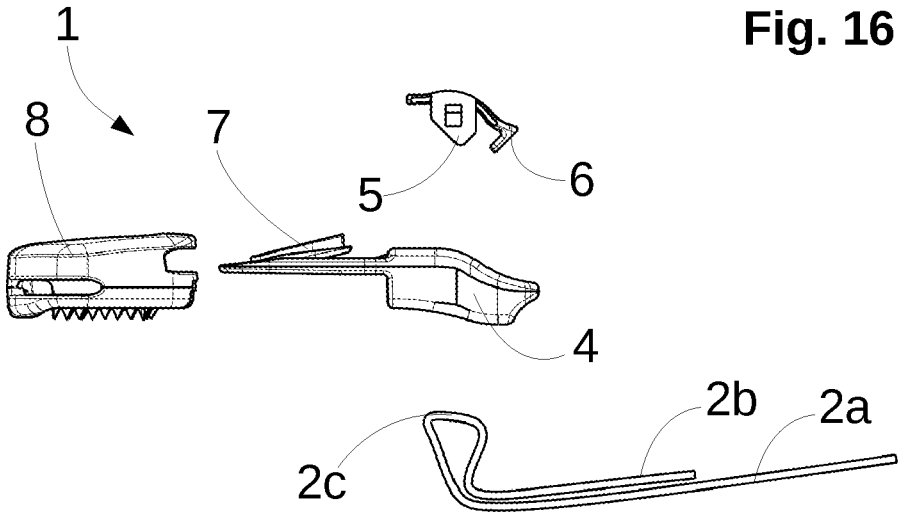
FIG. 16 schematically represents an exploded side view of the fourth embodiment of an adjustment system according to the invention.
Figure 17:
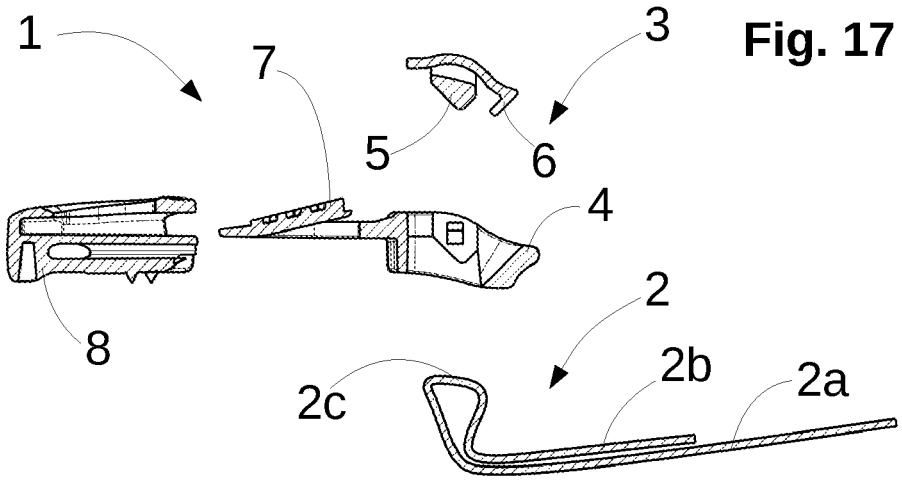
FIG. 17 schematically represents an exploded sectional view of the fourth embodiment of an adjustment system according to the invention.

In the embodiment illustrated in FIGS. 15 to 17, the partitioning wall 5 is fitted fixedly on the cover 6 and the assembly is fitted removably with respect to the body 4. The body 4 defines the through hole and the partitioning wall 5 divides the through hole into first through hole 4*a* and second through hole 4*b*. The assembly formed by the cover 6 and the partitioning wall 5 defines a slot for passage of the strap. The slot forms a part of the channel.

The strap 2 is inserted in the adjustment buckle 3 via the bottom face and makes a loop 2*c* inside the body 4 passing round the partitioning wall 5. The partitioning wall 5 divides the strap 2 into a first strand 2*a* and a second strand 2*b* that are arranged on one another at the entry and exit of the adjustment buckle 3. The intimate contact between the two strands 2*a*/2*b* when the strap 2 is tensioned jams the second strand 2*b* against the body 4 thereby enabling adjustment of the strap 2 to be preserved when the strap 2 is tensioned.

The adjustment system 1 also comprises a cover 6 fixed to the body 4 and fitted facing the partitioning wall 5 in second direction Z. The cover 6 and the partitioning wall 5 are separated by a greater distance than the thickness of the strap 2 so as to allow sliding of the strap 2 between the partitioning wall 5 and the cover 6. The cover 6 and the partitioning wall 5 define a slot designed to receive the strap 2. The height of the slot is greater than the thickness of the strap 2 so as not to hamper sliding of the strap 2 in the adjustment system 1 during the adjustment phases of the strap 2 in one direction or the other.

However, the cover 6 limits the possible movements of the strands of the strap 2 forming the loop 2*c* when at least one of the strands of the strap 2 is not tensioned. It was observed that when the strap 2 is pressed against a user's body, the user's movements induce a displacement of at least one strand of the strap 2 with respect to the adjustment buckle 3. These multiple displacements have the effect of making the strap 2 slide and move in one direction and then in the other. However, as the movements take place, a flexible loop 2*c* of the strap 2 eventually forms around the partitioning wall 5 resulting in loss of adjustment of the strap 2.

In order to limit the amplitude of the loop 2*c* of the strap 2, it is advantageous to fit a cover 6 that is at least facing the partitioning wall 5 so as to form an obstacle to movement of loop 2*c* of the strap 2 in second direction Z. The obstacle prevents the strap 2 from forming a loop 2*c* having too great an amplitude. In preferred manner, the minimum separating distance between the cover 6 and the partitioning wall 5 is less than five times the thickness of the strap 2, preferentially less than three times the thickness of the strap 2 and even more preferentially less than twice the thickness of the strap 2. The smaller the separating distance, the more difficult it is for the strap 2 to become maladjusted.

In a particular embodiment, the minimum separating distance between the cover 6 and the partitioning wall 5, i.e. the height of the slot, is comprised between 1.1 and 1.5 times the thickness of the strap 2, preferentially between 1.1 and 1.3 times the thickness of the strap 2.

In the embodiment illustrated in FIGS. 1 to 9, the partitioning wall 5 is formed by a single wall. The single wall defines at least two contact points with the strap 2 to impose deformation of the strap and follow the shape of channel. In another embodiment illustrated in FIGS. 10 to 14, the partitioning wall 5 is formed by several parts, preferably two parts. The two parts of the partitioning wall 5 respectively come into contact with the two strands 2*a*, 2*b* of the strap.

It is advantageous to avoid forming a cover 6 that presses against the strap 2 as this always places a strain on the same portion of the strap 2 when adjustment of the latter is very seldom performed. For example, when the strap 2 is used for adjustment of a leg loop, the adjustment of the strap 2 is seldom modified as the length of the leg loop is adjusted to match the user's morphology. An accentuated strain in the strap 2 will result in the latter ageing more quickly. Having a cover 6 separated from the partitioning wall by a greater distance than the thickness of the strap enables the strap 2 to be adjusted more easily to the right length.

The side walls that delineate first through hole 4*a* and second through hole 4*b* can be of any shape. In one configuration, the partitioning wall 5 can extend from the top face to the bottom face, i.e. over the whole thickness of the body 4 to separate the two through holes 4*a* and 4*b*. In another configuration, the partitioning wall 5 only extends over a part of the thickness of the body 4 and the two through holes 4*a* and 4*b* can join one another in the top face or in the bottom face. The different illustrated embodiments show configurations where the partitioning wall 5 does not extend up to the bottom face of the body 4.

Figure 4:
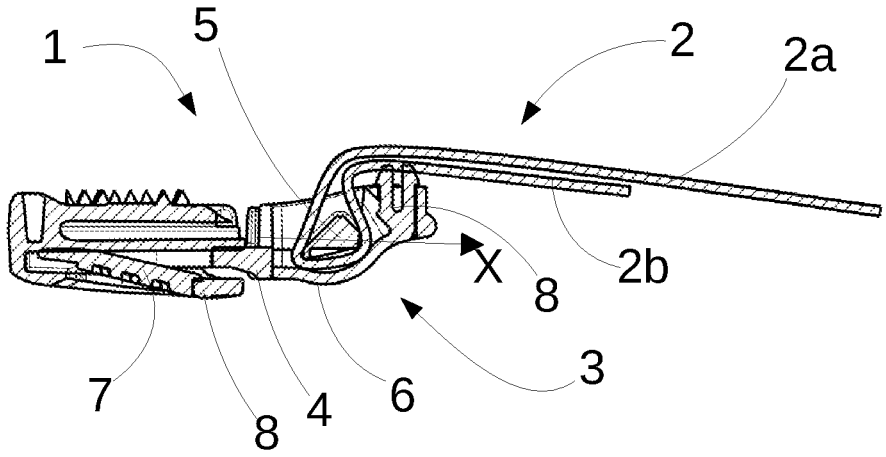
FIG. 4 schematically represents a longitudinal sectional view of the first embodiment of an adjustment system according to the invention.
Figure 5:
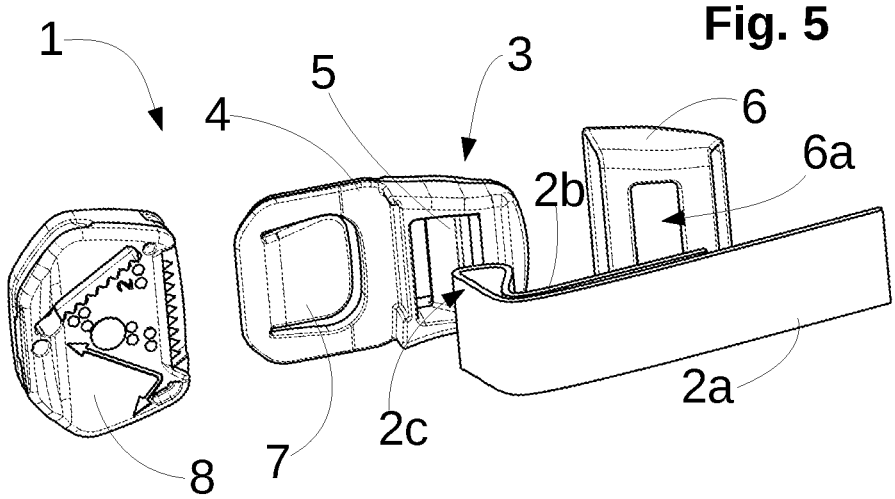
FIG. 5 schematically represents an exploded view of a second embodiment of an adjustment system according to the invention.
Figure 6:
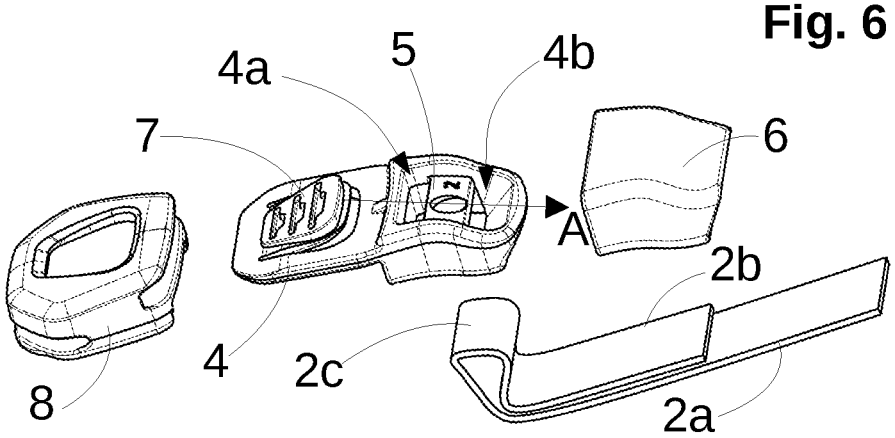
FIG. 6 schematically represents an exploded view of the second embodiment of an adjustment system according to the invention.
Figure 7:
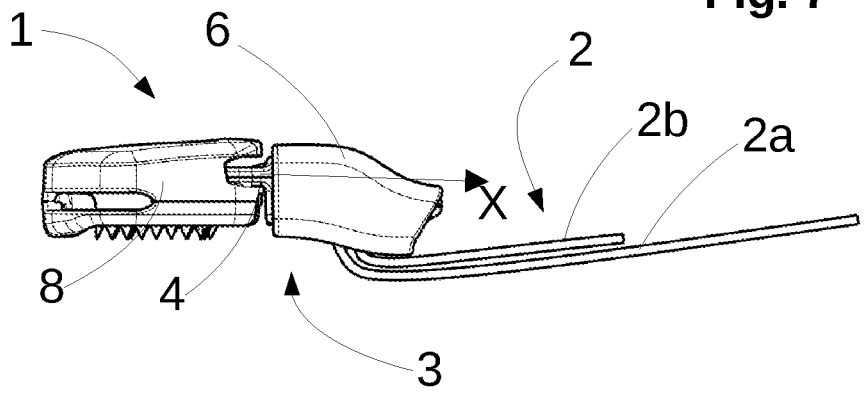
FIG. 7 schematically represents a side view of the second embodiment of an adjustment system according to the invention.
Figure 8:
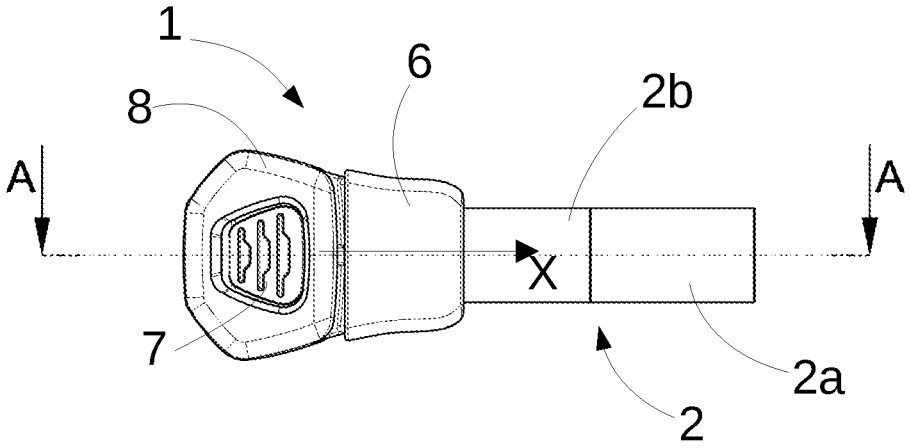
FIG. 8 schematically represents a top view of the second embodiment of an adjustment system according to the invention.
Figure 9:
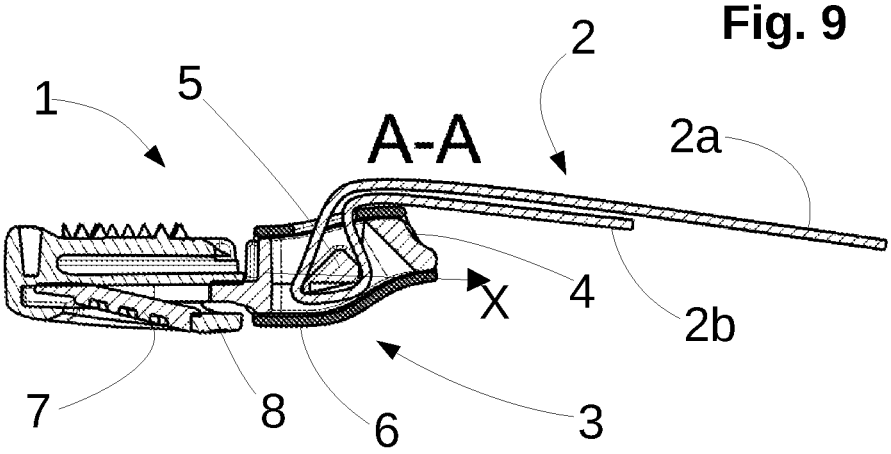
FIG. 9 schematically represents a longitudinal sectional view of the second embodiment of an adjustment system according to the invention.
Figure 10:
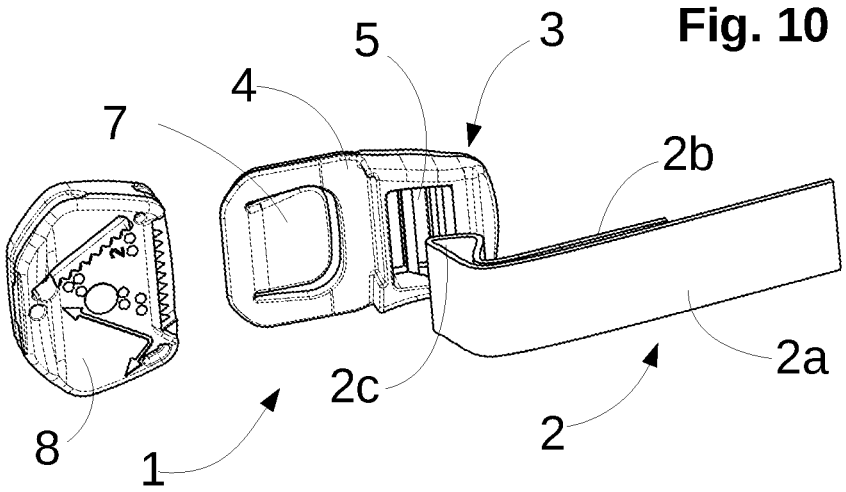
FIG. 10 schematically represents an exploded view of a third embodiment of an adjustment system according to the invention.
Figure 11:
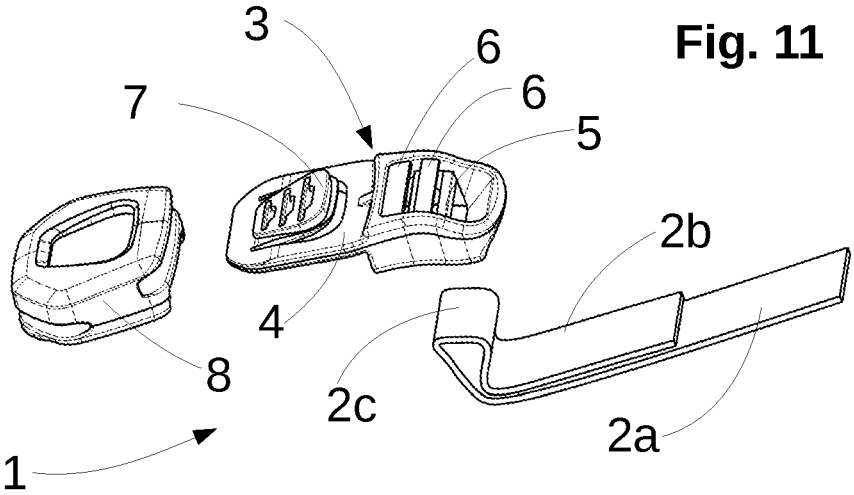
FIG. 11 schematically represents another exploded view of the third embodiment of an adjustment system according to the invention.
Figure 12:
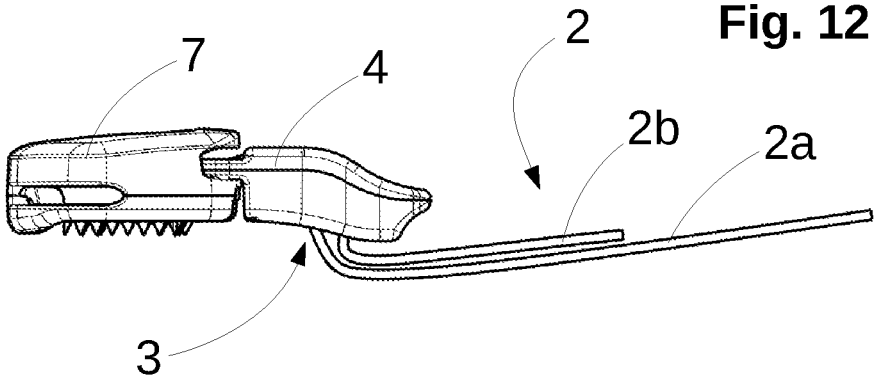
FIG. 12 schematically represents a side view of the third embodiment of an adjustment system according to the invention.
Figure 13:
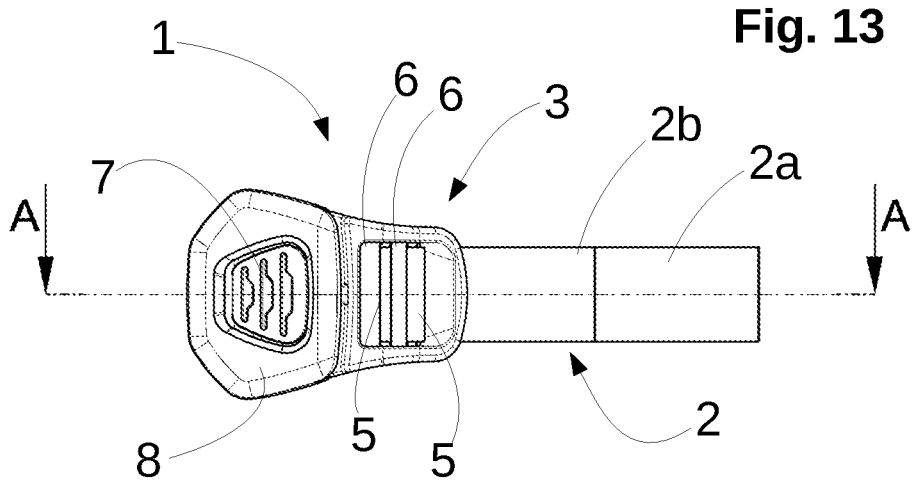
FIG. 13 schematically represents a top view of the third embodiment of an adjustment system according to the invention.
Figure 14:
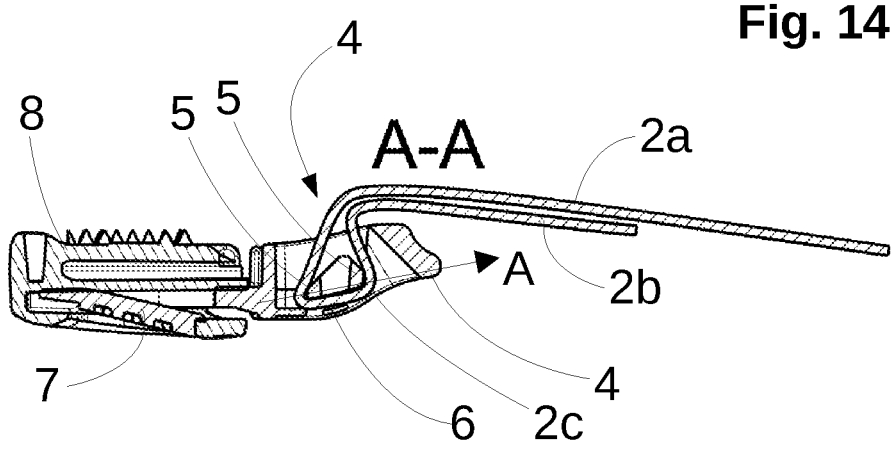
FIG. 14 schematically represents a longitudinal sectional view of the third embodiment of an adjustment system according to the invention.

The partitioning wall 5 can be of any cross-section in a longitudinal cutting plane of the strap 2. FIGS. 4, 9 and 14 illustrate three different configurations of the adjustment system 1 in a longitudinal cutting plane. In the three illustrated embodiments, the cross-section is substantially triangular. The edges can be broken or rounded to allow the strap 2 to slide more easily. It is advantageous for the partitioning wall 5 not to extend over the whole thickness of the body 4 so that the two strands of the strap 2 join together and form the loop 2*c* of the strap 2 with a radius of curvature that is less than ten times the thickness of the strap.

In an advantageous embodiment, the body 4 is made from polymer material. It is also preferable for the cover 6 to be made from polymer material. In the illustrated embodiments, the partitioning wall 5 is installed fixedly on the body 4. It is however possible for the partitioning wall 5 to be installed movably on the body 4 to be able to adjust the cross-section of first through hole 4*a* and/or of second through hole 4*b*.

In preferential manner, the separating distance between the partitioning wall 5 and the opposite side wall of the body 4 to define a channel for passage of a strand 2*a* of the strap 2 is larger than the thickness of the strap 2. Preferentially, the separating distance is at least 50% larger than the thickness, even more preferentially at least twice as large as the thickness. Such a distance enables the strap 2 to slide more easily during the adjustment phases.

As indicated in the foregoing, to facilitate sliding of the strap 2, it is advantageous for the partitioning wall 5 to only extend over a part of the thickness of the body 4 between the top face and the bottom face.

In an advantageous embodiment illustrated in FIGS. 1 to 9, the cover 6 is fitted removable with respect to the body 4. By using a removably mounted the cover 6, it is possible to improve an adjustment buckle 3 that is already in use. Removal of the cover 6 facilitates adjustment of the strap 2 and/or enables the strap 2 to be made to pass more easily through first through hole 4*a* and second through hole 4*b* of the body 4.

In the embodiment illustrated in FIGS. 10 to 14, the cover 6 is fitted unremovable from the body 4. The cover 6 can be a rod. In a particular embodiment, the cover 6 can be formed by several rods. It is advantageous for the body 4 to define one or more through holes to facilitate installation of the strap along the channel.

Advantageously, the cover 6 continuously covers first through hole 4*a*, the partitioning wall 5 and second through hole 4*b* in second direction Z. In the embodiment illustrated in FIGS. 1 to 9, the cover 6 continuously covers first through hole 4*a*, the partitioning wall 5 and second through hole 4*b* so as to prevent access to the strap 2 from the top face. The cover 6 can be devoid of holes. It is also possible to have a cover 6 provided with one or more holes. The holes each have a cross-section that is smaller than the cross-section of the strap 2. The strap 2 cannot exit via the top face of the adjustment buckle 3 through the cover 6.

In an advantageous embodiment, the cover 6 transforms first through hole 4*a* and second through hole 4*b* of the body 4 into non-through holes. The cover 6 closes off the through holes of the body 4 to make them blind holes.

Figure 2:
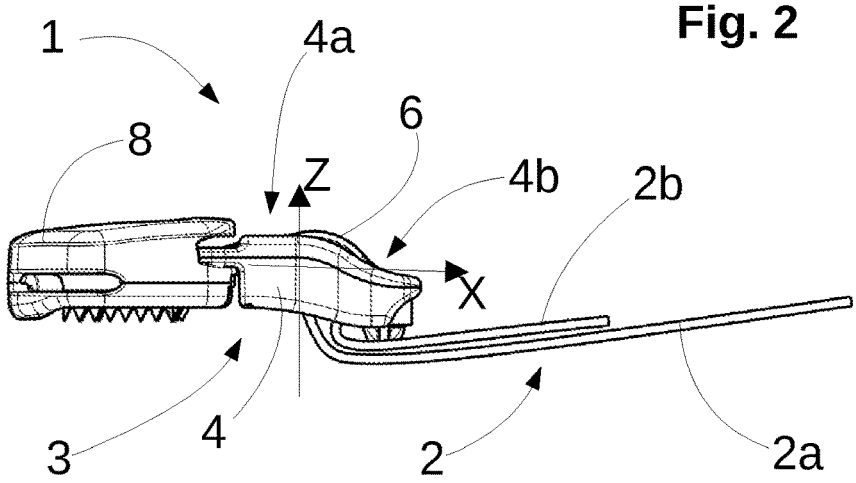
FIG. 2 schematically represents a side view of the first embodiment of an adjustment system according to the invention.
Figure 3:
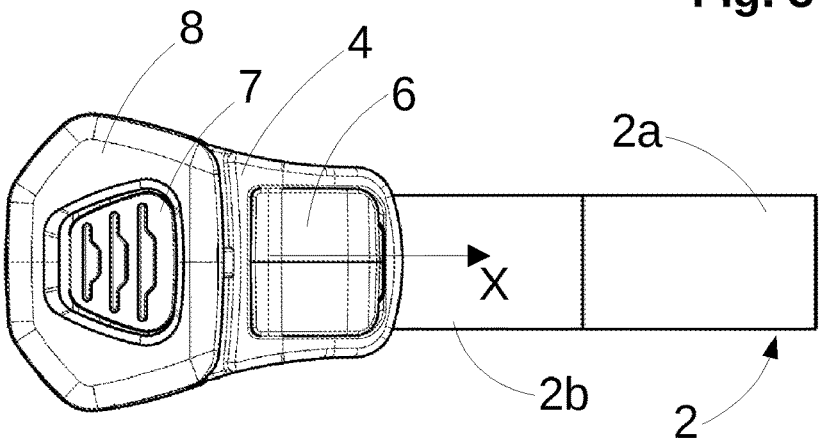
FIG. 3 schematically represents a top view of the first embodiment of an adjustment system according to the invention.

In preferential manner illustrated in FIGS. 1 to 3, the cover 6 is clip-fastened to body 4. Installation of a cover 6 clip-fastened to the body 4 makes assembly and removal quick and easy without modifying the adjustment of the strap 2 and more particularly sliding of the latter inside the adjustment buckle 3 when one strand 2*a* or the other strand of the strap 2 is pulled on. Removal of the cover 6 facilitates adjustment of the strap 2 to the right size. Once the strap 2 has been adjusted, the cover 6 can be installed which makes unintentional maladjustment of the strap 2 more difficult. The cover 6 can be clip-fastened by means of an elastically deformable foot 6*b* inserted in a receptacle of the body 4.

It is advantageous to provide an embodiment wherein the cover 6 is fitted sliding on the body 4. The cover 6 is fitted sliding in a first direction X. The cover 6 has a hole 6*a* for passage of the strap 2. Passage hole 6*a* opens out facing first through hole 4*a* and second through hole 4*b*. In the embodiment illustrated in FIGS. 5 to 9, the cover 6 covers the top face and the bottom face. The cover 6 forms a ring in a view in a cutting plane perpendicular to first direction A. In preferred manner, the cover 6 has a substantially complementary shape to the external profile of the adjustment buckle 3.

In the embodiments that are illustrated in FIGS. 1 to 14, the adjustment buckle 3 has a first fixing means configured to fix a second fixing means in removable manner. The first fixing means and second fixing means together form a fastening clip assembly. In the illustrated configurations, the adjustment buckle 3 has a flexible tab 7 that is designed to be inserted in a fastening means 8 that defines a cavity. The fastening means 8 defines a slot and the flexible tab 7 deforms to be inserted in cavity. Once it is in the cavity, the flexible tab 7 reverts to a rest state and opposes movement in the opposite direction to that of its insertion in the cavity 9. In advantageous manner, the fastening means 8 is fixed to an attachment point, for example a strap.

In the embodiment illustrated in FIGS. 15 to 17, the cover 6 is fitted removable with respect to the body 4. The cover 6 defines the partitioning wall 5. The partitioning wall 5 is fitted movable with respect to the body 4. The body 4 defines a through hole and the partitioning wall enables first through hole 4*a* and second through hole 4*b* to be defined when the cover 6 is fixed to the body 4. When the strap 2 is tensioned, it prevents the body 4 and the cover 6 from being disunited. The first strand 2*a* passes through the body and then passes through the cover 6 to pass round the partitioning wall 5. The second strand 2*b* exits the cover 6 passing round the partitioning wall 5 and then passes again through the body in the opposite direction to that of the first strand. In the same way as for the other embodiments, the cover 6 forms the obstacle that opposes enlargement of the loop when the first strand 2*a* or the second strand 2*b* is pushed in the direction of the adjustment buckle.

The adjustment buckle does not comprise any movable part that blocks the strap against the body 4, the partitioning wall 5 or the cover 6.

The invention claimed is:

1. An adjustment system comprising:

a strap having a thickness that is smaller than a width, the width being smaller than a length, the strap being divided into a first strand and a second strand, the second strand continuously extending the first strand;

an adjustment buckle configured to perform adjustment of the strap, the adjustment buckle defining a channel receiving the strap, the strap being able to slide in the channel by pulling on the first strand or the second strand, the channel having a width at least equal to the width of the strap and a height larger than the thickness of the strap;

wherein the adjustment buckle has a body, a partitioning wall and a cover that define the channel, the strap being inserted in the body via the first strand and passing round the partitioning wall to define a loop and exit from the body via the second strand, the cover being fitted removable with respect to the body;

wherein the cover and the partitioning wall define a slot for the strap to pass through and the cover is separated from the partitioning wall by a distance larger than the thickness of the strap and less than three times the thickness of the strap so as not to impede the sliding of the strap, the cover having an inner surface facing the strap in a first direction and being configured to obstruct enlargement of the loop, wherein the first direction is a direction of measurement of the thickness of the strap between two deformation points of the strap, the two deformation points corresponding to two contact points between the strap and the partitioning wall between which the strap makes a U-turn.

2. The adjustment system according to claim 1, wherein the at least one partitioning wall is mounted fixedly on the cover.

3. The adjustment system according to claim 1, wherein the at least one partitioning wall is mounted fixedly on the body.

4. The adjustment system according to claim 1, wherein the cover continuously covers the partitioning wall and the first strand arranged in the body in the first direction.

5. The adjustment system according to claim 1, wherein the body defines at least one through hole receiving one of the first strand or the second strand of the strap and the cover covers the through hole.

6. The adjustment system according to claim 1, wherein the cover is clip-fastened on the body.

7. The adjustment system according to claim 1, wherein the cover is mounted slidingly on the body, the cover having a top surface and a bottom surface, the bottom surface having a hole for the strap to pass through, the top surface having the inner surface facing the strap in a first direction and being configured to obstruct enlargement of the loop.

8. The adjustment system according to claim 1, wherein the partitioning wall only extends over a part of a thickness of the body between a top surface and a bottom surface.

9. An adjustment system comprising:

a strap having a thickness that is smaller than a width, the width being smaller than a length, the strap being divided into a first strand and a second strand, the second strand continuously extending the first strand;

an adjustment buckle configured to perform adjustment of the strap, the adjustment buckle defining a channel receiving the strap, the strap being able to slide in the channel by pulling on the first strand or the second strand, the channel having a width at least equal to the width of the strap and a height larger than the thickness of the strap;

wherein the adjustment buckle has a body, a partitioning wall and a cover that define the channel, the strap being inserted in the body via the first strand and passing round the partitioning wall to define a loop and exit from the body via the second strand, the partitioning wall being fitted stationary with respect to the body;

wherein the cover and the partitioning wall define a slot for the strap to pass through and the cover is separated from the partitioning wall by a distance larger than the thickness of the strap and less than three times the thickness of the strap so as not to impede the sliding of the strap, the cover having an inner surface facing the strap in a first direction and being configured to obstruct enlargement of the loop, wherein the first direction is a direction of measurement of the thickness of the strap between two deformation points of the strap, the two deformation points corresponding to two contact points between the strap and the partitioning wall between which the strap makes a U-turn.

10. The adjustment system according to claim 9, wherein the cover continuously covers the partitioning wall and the first strand arranged in the body in the first direction.

11. The adjustment system according to claim 9, wherein the body defines at least one through hole receiving one of the first strand or the second strand of the strap and the cover covers the through hole.

12. The adjustment system according to claim 9, wherein the cover is clip-fastened on the body.

13. The adjustment system according to claim 9, wherein the cover is mounted slidingly on the body, the cover having a top surface and a bottom surface, the bottom surface having a hole for the strap to pass through, the top surface having the inner surface facing the strap in a first direction and being configured to obstruct enlargement of the loop.

14. The adjustment system according to claim 9, wherein the partitioning wall only extends over a part of the thickness of the body between a top surface and a bottom surface.

* * * * *